US008276227B2

(12) United States Patent
Pileggi

(10) Patent No.: US 8,276,227 B2
(45) Date of Patent: Oct. 2, 2012

(54) MULTI-ADJUSTABLE PILLOW

(76) Inventor: Vincent J. Pileggi, Warwick, PA (US)

( * ) Notice: Subject to any disclaimer, the term of this patent is extended or adjusted under 35 U.S.C. 154(b) by 0 days.

(21) Appl. No.: 12/975,947

(22) Filed: Dec. 22, 2010

(65) Prior Publication Data

US 2011/0145994 A1 Jun. 23, 2011

Related U.S. Application Data

(60) Provisional application No. 61/289,687, filed on Dec. 23, 2009.

(51) Int. Cl.
*A47G 9/00* (2006.01)

(52) U.S. Cl. ..... 5/640; 5/636; 5/657; 5/630; 5/652

(58) Field of Classification Search ..... 5/636, 640, 5/657, 630, 652
See application file for complete search history.

(56) References Cited

U.S. PATENT DOCUMENTS

| | | | | | |
|---|---|---|---|---|---|
| 247,892 | A | | 10/1881 | Doremus | |
| 395,043 | A | * | 12/1888 | Doremus | 5/640 |
| 572,959 | A | | 12/1896 | Chapman | |
| 1,200,858 | A | * | 10/1916 | Linder | 441/115 |
| 1,385,355 | A | | 7/1921 | Banks | |
| 1,447,288 | A | | 3/1923 | Emmerich | |
| 2,952,856 | A | | 9/1960 | Ruff | |
| 3,849,810 | A | | 11/1974 | Degen | |
| 4,171,549 | A | | 10/1979 | Morrell et al. | |
| 4,274,673 | A | | 6/1981 | Kifferstein | |
| 4,345,345 | A | | 8/1982 | Holtz | |
| 4,550,459 | A | * | 11/1985 | Endel et al. | 5/640 |
| 4,768,248 | A | * | 9/1988 | O'Sullivan | 5/640 |
| 4,956,886 | A | * | 9/1990 | Sarkozi | 5/640 |
| 5,020,174 | A | * | 6/1991 | Sarkozi | 5/640 |
| 5,165,130 | A | * | 11/1992 | Wendling | 5/655 |
| 5,363,524 | A | | 11/1994 | Lang | |
| 5,864,904 | A | | 2/1999 | Rudick | |
| 6,363,557 | B2 | | 4/2002 | Chou | |
| 6,601,252 | B1 | * | 8/2003 | Leach | 5/632 |
| 6,641,220 | B2 | * | 11/2003 | Clegg | 297/397 |
| 6,671,906 | B1 | | 1/2004 | Milligan | |
| 6,691,352 | B2 | | 2/2004 | Wang | |
| 6,715,171 | B2 | * | 4/2004 | Grabe | 5/644 |
| 6,976,280 | B2 | | 12/2005 | Coutts | |
| 7,325,266 | B1 | | 2/2008 | Olson | |
| 7,513,002 | B2 | | 4/2009 | Best | |
| 7,770,248 | B2 | * | 8/2010 | Furlow | 5/722 |
| 2004/0139550 | A1 | | 7/2004 | Calagui | |
| 2006/0213012 | A1 | | 9/2006 | Nakasato et al. | |
| 2008/0028530 | A1 | | 2/2008 | Hao | |
| 2008/0155753 | A1 | | 7/2008 | Cretsinger | |
| 2009/0313761 | A1 | * | 12/2009 | North et al. | 5/632 |
| 2010/0077551 | A1 | * | 4/2010 | Liu et al. | 5/636 |

* cited by examiner

FOREIGN PATENT DOCUMENTS

| | | | |
|---|---|---|---|
| GB | 2052255 A | * | 1/1981 |
| WO | 9838892 | | 9/1998 |

*Primary Examiner* — William Kelleher
(74) *Attorney, Agent, or Firm* — Fox Rothschild LLP

(57) ABSTRACT

A pillow having a first pillow and a second smaller pillow attached to a face of the main pillow by an attachment member that is of sufficient length and flexibility to allow the second pillow to be positioned in an infinite number of parallel and/or skewed orientations relative to the first pillow. A third pillow, also smaller than the first pillow, can be attached to the first pillow on a face opposite the second pillow by another attachment member that is of sufficient length and flexibility to allow the second pillow to be positioned relative to the first pillow and second pillow in an infinite number of parallel and/or skewed orientations. The invention provides a fully formed pillow and a pillow cover.

18 Claims, 6 Drawing Sheets

1/6

78
42
62
60
72
70
48
68
92
74
66
94
68a
64
86
96
10
10
48
76

MULTI-ADJUSTABLE PILLOW

CROSS-REFERENCE TO RELATED APPLICATION

This application claims the benefit of U.S. Provisional Application 61/289,687, filed Dec. 23, 2009, and which is hereby incorporated herein by reference.

FIELD OF THE INVENTION

This invention relates to an improved adjustable pillow.

BACKGROUND OF INVENTION

Various types of pillows are known for providing comfort and support to the user. For example, people use pillows when sleeping, watching television, reading, resting, etc. Pillows can be used on the floor, on couches and chairs and, of course, in bed. Most pillows have one form or shape and limited adjustability or flexibility. Known pillows are therefore limited in their ability to provide the full comfort and support desired.

For example, when laying on the floor or couch to watch television, read, use a lap top computer, rest, etc, people may use two or more pillows for support and or for comfort, such as to support the curvature of their neck. Such pillows are not fully satisfactory, and can lead to stiff necks and discomfort. Even people sitting up on a couch or chair desire support for their lower back.

Pillow cases and covers are also known in the art, but these provide mainly a simple protective cover for the pillow. They do not add features to the pillow being covered, or substantially change the pillow in any way.

Accordingly, it is desirable to provide a multi-adjustable pillow that is capable of infinite variations to suit the pleasure and comfort of the user with simple adjustments, and which can be configured to support the various parts of the body for different uses. Such support, comfort, and flexibility is believed lacking in presently known devices.

SUMMARY OF THE INVENTION

One or more embodiments of the present invention disclose a pillow that can be converted and or adjusted into various forms and positions. In one embodiment, an apparatus is disclosed comprising a pillow having such features. In another form, a pillow case for use in converting a common type pillow into one having the features of the present invention is provided.

In broad terms the pillow provides a main pillow, and a smaller satellite pillow attached to the main pillow via a flap that allows the satellite pillow to be adjusted in position relative to the main pillow while remaining attached thereto. Another embodiment of the invention provides a second smaller satellite pillow attached to the main pillow on a side opposite from the first satellite pillow via a second flap that allows the second satellite pillow to be adjusted in position relative to the main pillow. The first and second satellite pillows can have different characteristics to provide maximum flexibility, e.g., different sizes, shapes, firmness, etc.

BRIEF DESCRIPTION OF THE DRAWINGS

The accompanying drawings, which are incorporated in and constitute a part of the specification, illustrate presently preferred embodiments of the invention. Together with the general description given above and the detailed description of the preferred embodiments given below, they serve to explain the principles of the invention.

DETAILED DESCRIPTION OF THE INVENTION

Figure 1:
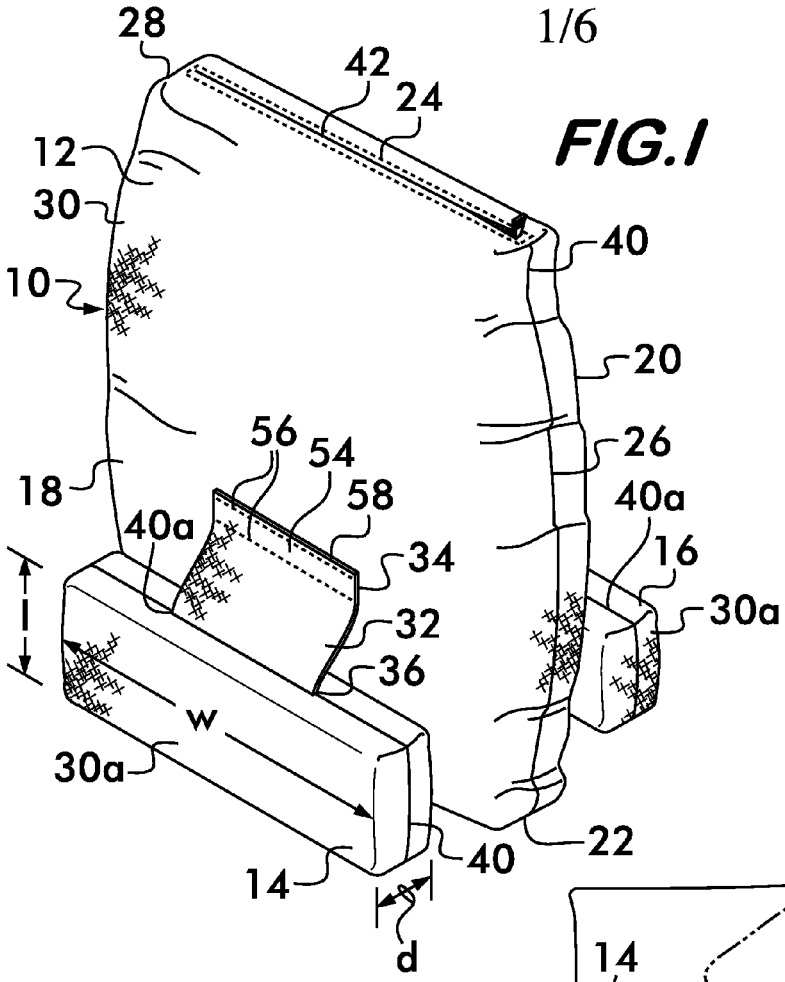
FIG. 1 is a perspective view of a pillow in accordance with the present invention.

A first embodiment of the present invention is now described in detail with reference to FIGS. 1 through 5 showing a multi-adjustable pillow 10. The pillow 10 has a main pillow 12, and first and second satellite pillows 14 and 16 flexibly attached to the main pillow 12.

The main pillow 12 is preferably generally rectangular as shown, having a first face 18 and a second face 20 opposite the first face 18. The two faces 18, 20 are attached to one another at top and bottom ends 22, 24, respectively, and at first and second side ends 26, 28, respectively, opposite one another as shown (the pillow bottom end 24 is shown in the upward position in FIG. 1). The main pillow 12 can be similar to any known pillow, for example, having an outer cover 30 made of a fabric suitable for use as a pillow, and a cushioned interior 48 such as a soft fiber fill (see FIG. 4). Alternative shapes and sizes are possible.

The first satellite pillow 14 is similarly and preferably generally rectangular as shown having a length L substantially smaller than the length of the main pillow 12, a width W smaller than the width of the main pillow 12, and a depth D smaller than the depth of the main pillow. Again, similar to the main pillow 12, the first satellite pillow 14 can have an outer cover 30*a* made of a fabric suitable for use as a pillow, and a cushioned interior 48 such as a soft fiber fill (see FIG. 4), both of which preferably are the same as that for the main pillow 12. The orientation of the various dimensions, e.g., length L, width W and depth D, as used throughout this document are the same as indicated in FIG. 1 in reference to satellite pillow 14. Again, alternative shapes and sizes are possible.

Figure 2:
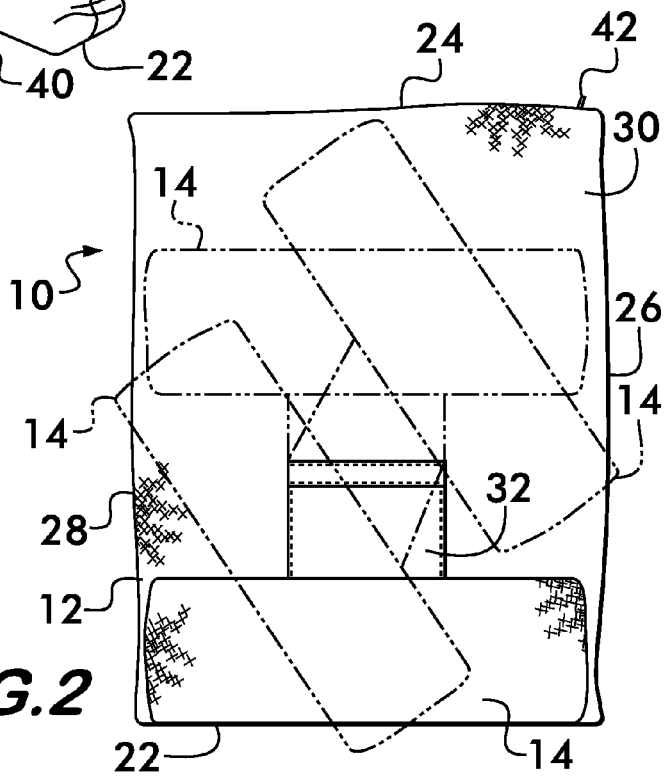
FIG. 2 is a front plan view of the pillow of FIG. 1 illustrating various positions of a satellite pillow.
Figure 3:
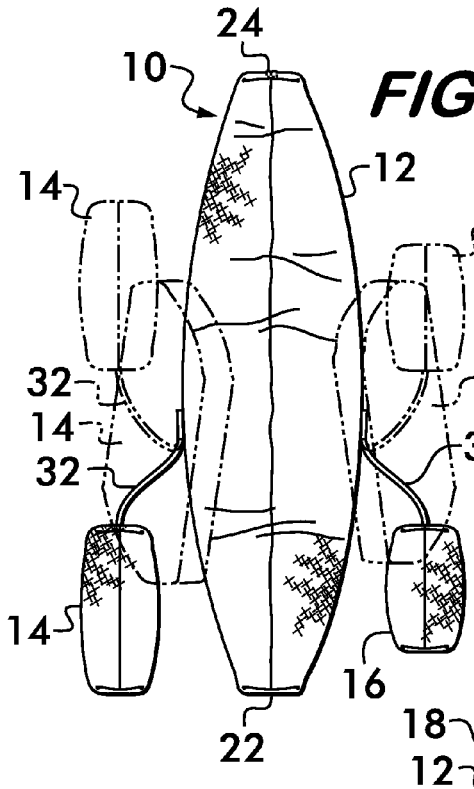
FIG. 3 is a side view of the pillow of FIG. 2 illustrating various positions of the satellite pillows.

A first flexible attachment member 32 adjustably attaches the first satellite pillow 14 to the first face 18 of the main pillow 12. The attachment member 32 has a first end 34 attached to the main pillow first face 18 between the top and bottom ends 22, 24, and a second end 36 attached to the first satellite pillow 14 as shown. The attachment member 32 is sufficiently flexible (foldable and manipulable) to allow the satellite pillow 32 to be positioned in any one of an infinite number of positions relative to the main pillow 12, e.g., substantially parallel or skewed orientations as illustrated in FIGS. 2 and 3. The attachment member 32 can be made of any suitable material, and is preferably made of the same material as is the covers 30, 30*a* of the main pillow 12 and the satellite pillows.

The second satellite pillow 16 is similar in configuration and construction to the first satellite pillow 14, and attached to the main pillow 12 by a second attachment member 38 at first and second ends 34, 36 similar to the first attachment member 32. The second attachment member is likewise sufficiently flexible (foldable and manipulable) to allow the satellite pillow 16 to be positioned in any one of an infinite number of positions relative to the main pillow 12, e.g., substantially parallel or skewed orientations as illustrated in FIGS. 2 and 3. In the preferred embodiment, the second satellite pillow 16 is similar in width and depth as that of the first satellite pillow, but is smaller in length, and is less firm. Nevertheless, as with the other pillows, the second satellite pillow can be of any size, shape and firmness.

As illustrated in FIGS. 2 and 3, the two satellite pillows 14, 16 provide unlimited configurations and adjustability. The satellite pillows can be angled relative to the main pillow 12 and to one another for additional adjustability. It is further appreciated that the three pillows 12, 14, 16 can be of different characteristics, e.g., different shapes, sizes and firmness. This allows infinite adjustability for use and comfort anywhere, e.g., with a chair, couch, floor, etc. For example, one satellite pillow 14 can be place towards the top end of the main pillow 12 while the other satellite pillow 16 can be placed towards the bottom end. The two satellite pillows can further be angled for the desired comfort. It also appreciated that a satellite pillow can be positioned to elevate an end of the main pillow 12.

Figure 4A:
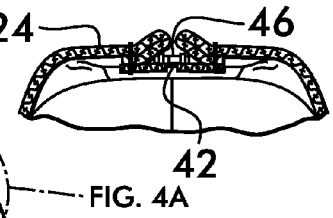
FIG. 4A is an enlarged view of area 4A of FIG. 4 showing the zipper area.
Figure 4:
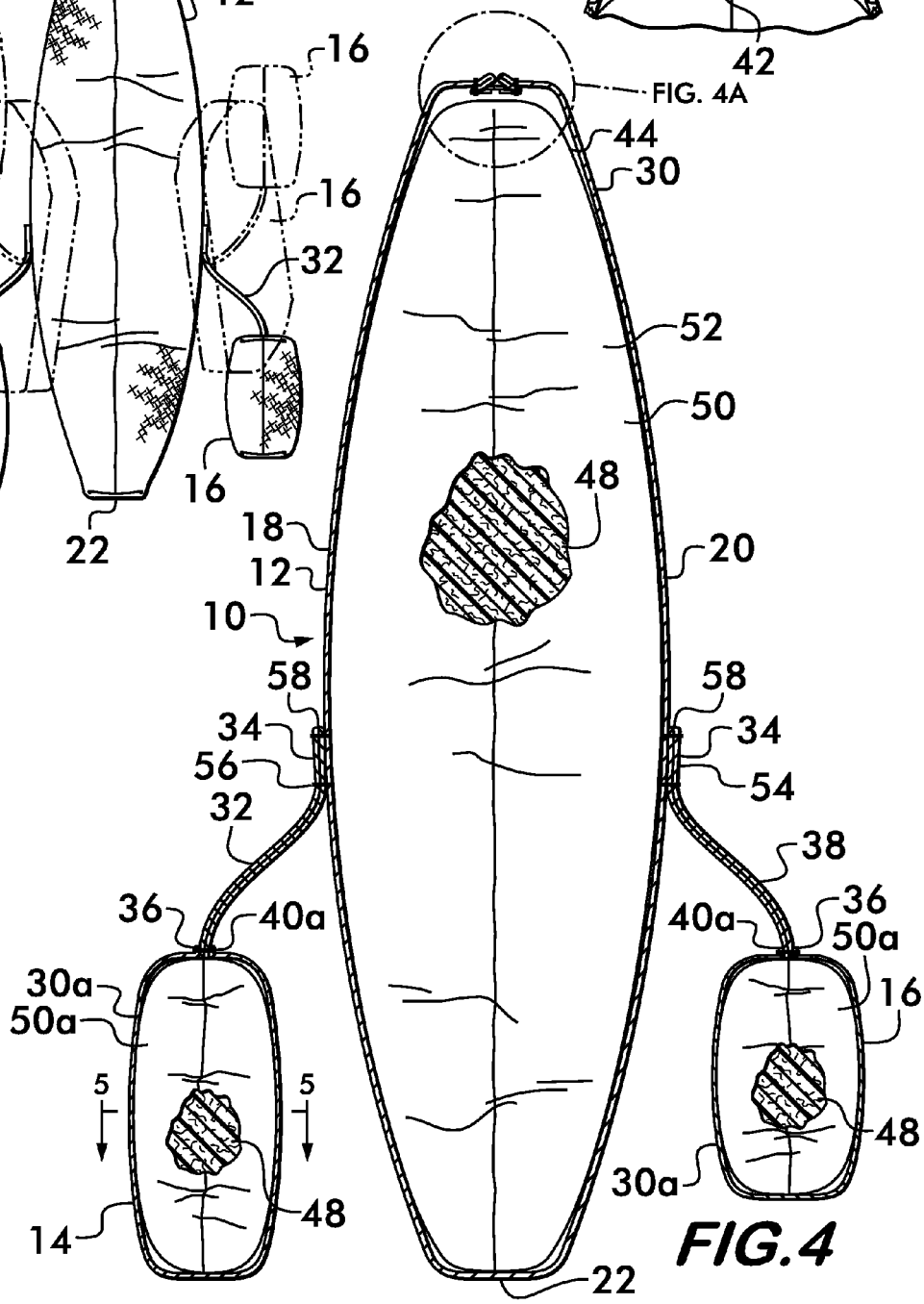
FIG. 4 is a cross sectional view of the pillow of FIG. 1.
Figure 5:
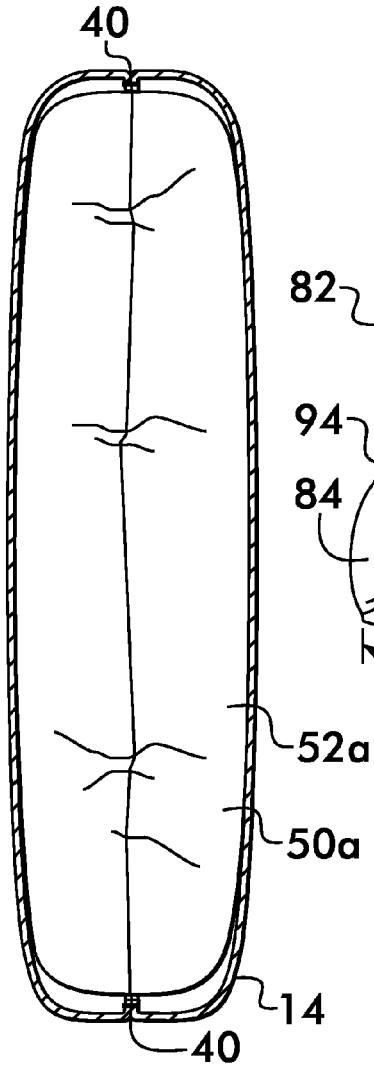
FIG. 5 is a sectional view taken along line 5-5 in FIG. 4.

In the presently illustrated embodiment of the comfort pillow 10, the main pillow 12 is the largest, approximately 21 inches length by 18 inches width by 6 inches depth after the addition of soft fiber fill inside (it being appreciated that because filler is added, these measurements are approximate and can vary). For other embodiments, a range of lengths between 21 and 24 inches, and a range of widths 18 and 22 inches may be preferred. The main pillow 12 is constructed using any suitable techniques such as known stitching/sewing techniques used for standard pillows. For example, edges 26 and 28 of the cover 30 have seams placed inside and are sewn together using known techniques. Stitched seams 40 are indicated in the Figures. The main pillow top 22 is formed by a fold in the cover material 30 and therefore is seamless. A zipper 42 providing access to the pillow interior 44 sits within a protective pocket 46 formed at the bottom end 24 by folding and sewing the end of the cover material 30 as is known in the art (FIG. 4A). Any suitable zipper may used, a non-metal zipper 42 being preferred.

The main pillow cover 30 can be formed of any suitable fabric. For example, a woven furniture grade fabric, leather, vinyl, or any other known suitable material can be used as is known in the art. Inside the cover 30, any suitable cushion material 48 useable with pillows can be used, such as a washable, non-allergenic and resilient polyester fill. In a preferred embodiment as illustrated, an insert pillow 50 is provided having its own fabric cover 52 pre-filled with the cushion material 48 (here fiber fill) to prevent the fiber material from bleeding through the outer cover 30. Any suitable liner cover material, such as cloths, can be used. In one preferred embodiment, an insert pillow 23 inches length by 18 inches width sewn all the way around (no zippers) is used, being slightly larger than the main cover 30 to provide the desired feel and firmness.

The first satellite pillow 14 is approximately 7.5 inches length L by 14 inches width W by 3.5 inches depth D after the addition of cushion material 48 within (here fiber fill), and the second satellite pillow 16 is approximately 6 inches length L by 14 inches width W by 3.5 inches depth D before the addition of cushion material 48. For other satellite pillow embodiments, a range of lengths between 6 and 16 inches, and a range of widths between 14 and 16 inches may be preferred. The first satellite pillow 14 is stuffed with additional fiber fill 48 to be firmer than the second satellite pillow 16. The outer covers 30*a* of the satellite pillows 14, 16 can be made of any known material, and preferably the same material as is the main pillow outer cover 30. Likewise, any known cushion material 48 can be used, e.g., other known materials include down, feathers, foam and buckwheat. Again, known construction techniques can be used, e.g., known sewing/stitching techniques with seams placed inside. In the illustrated embodiment, the satellite pillows 14, 16 contain an insert pillow 50*a* having a cover 52*a* filled with filler 48 similar in construction and materials of the insert pillow 50 of the main pillow 12. The outer covers 30*a* of the satellite pillows are sewn shut once the insert pillows 50*a* are added. An alternative embodiment could include a zipper or other closure means to allow access for removal or replacement of the insert pillows 50*a*.

The attachment members 32, 38 are approximately 3 inches length L by 9.5 inches width W (these dimensions being for that part of the members 32, 38 that are free to move and thus are unbound). As noted above, the attachment members are preferably made of the same material as the outer cover 30 of the main pillow 12, here two layers of fabric sewn together to provide a finished look on both sides as well as to provide strength. An approximately 1 inch end strip 54 of the attachment member material (in addition to the 3 inches length) is attached to the main pillow 12 preferably with 4 runs of stitches 56; the opposite end 36 of the attachment member 32 is sewn as part of a seam 40*a* of the satellite pillows. An edge 58 of the attachment members 32, 38 is approximately 10 inches from the upper end 22 of the main pillow 12.

It is understood that the above dimensions, configurations, and materials of the multi-adjustable pillow 10, e.g., size, firmness, shape, and materials are by way of example only and that the invention is not so limited. Any combination of sizes, firmness, shapes and materials can be used as desired.

It is also appreciated that there are various methods for making the present invention. In the illustrated embodiment, the main pillow 12 is formed as a pillow cover 30 of woven fabric material sewn together as known and having a zippered opening 42 through which a pre-made filled pillow insert 50 is inserted. For increased stiffness, an inert pillow 50 larger than the main pillow cover 30 can be used, the size of the inserted pillow 50 relative to the pillow cover 30 as well as the firmness of the inserted pillow control the stiffness of the main pillow 12. The user can replace the insert pillow 50 with one of desired firmness. The satellite pillows 14, 16 preferably are made of the same fabric as the main pillow 12 and sewn to form. Here, each of the satellite pillows 14, 16 also receive an insert pillow 50*a* stuffed with polyester fill 48 before being stitched closed. It is appreciated that the main pillow 12 can be filled directly with a cushion material rather than inserted with a pre-made insert pillow, in which case a zipper would not be required and the main pillow would be sewn shut. Alternatively the satellite pillows 14, 16 can include a zipper 42 through which a pre-made insert pillow 50*a* can be added. The attachment members 23 are made of the same fabric as the pillows 12, 14, 16 and are preferably made of two layers of fabric sewn together so that both faces are finished. The attachment members are likewise stitched to the respective pillows. Alternative attachment means of the satellite pillows is also contemplated, such as Velcro. Such attachable/detachable satellite pillows allow attachment by the user of satellite pillows 14, 16 having the desired firmness, shape, size, etc.

It is further contemplated that other means can be used to provide the desired firmness. For example, the cushion material 48 within the main and satellite pillows could be provided by air bladders, e.g., either with another cushion material 48 (e.g., fiber fill) or by itself. These can be adjusted by adding or removing air for the desired firmness. Any suitable materials, such as rubber, plastic and polymer bladder materials used in air beds and air mattresses can be used. Such bladders would have the desired shape, and preferably include a valve for adding and removing air.

A second embodiment of the present invention, a multi-adjustable bed pillow 60, is now described with reference to FIGS. 6 to 10. The bed pillow 60 has a generally rectangular main pillow 62 and a generally rectangular smaller satellite pillow 64 attached via a flexible attachment member 66.

In the illustrated embodiment, the main pillow 62 is formed as an outer pillow case or cover 68 for receiving a standard bed pillow 70 having cushion material 48 within, such as fiber fill, as is known in the art. It has two opposing faces 72 and 74 attached to one another at top and bottom ends 76 and 78, and at first and second opposing side ends 80 and 82 as shown. The outer pillow case 68, similar to known pillow cases and covers, has a preferably non-metal zipper 42 allowing a standard premade pillow 70 (FIG. 9) to be inserted therein for use and to allow removal for cleaning. The pillow case 68 can be made of any suitable material such as fabrics and cloths typically used for bed pillow cases and covers, and made by any known means such as by known sewing/stitching techniques. It is appreciated that the main pillow 62 can alternatively be made not as a cover, but a complete pillow with its own filler 48 sealed within as discussed above with reference to the embodiment of FIG. 1.

Figure 6:
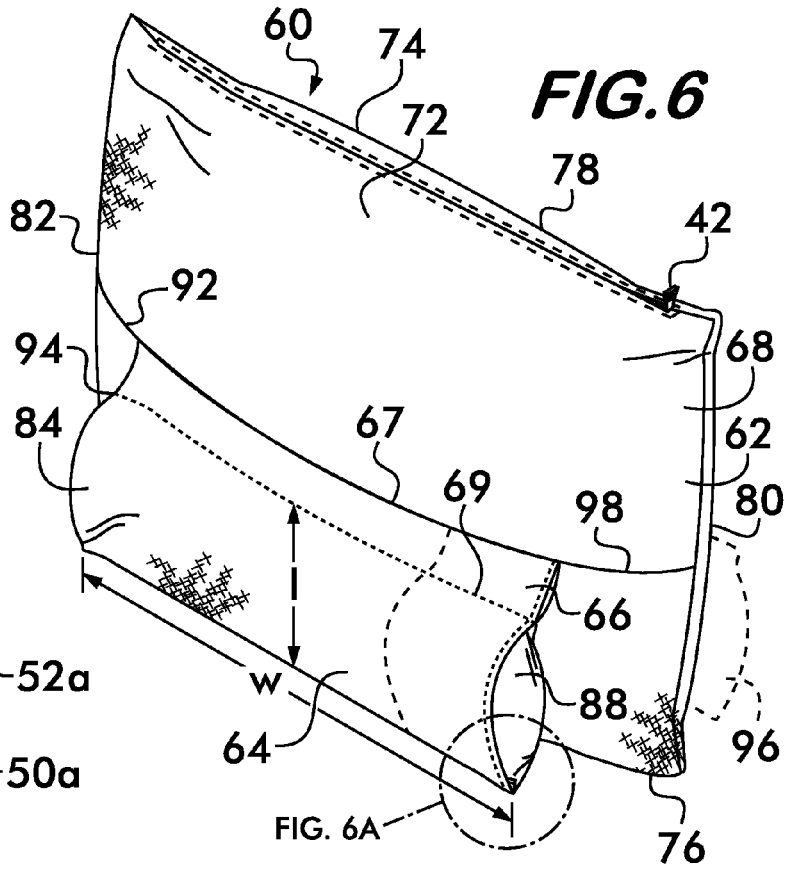
FIG. 6 is a perspective view of a second embodiment of the present invention.
Figure 6A:
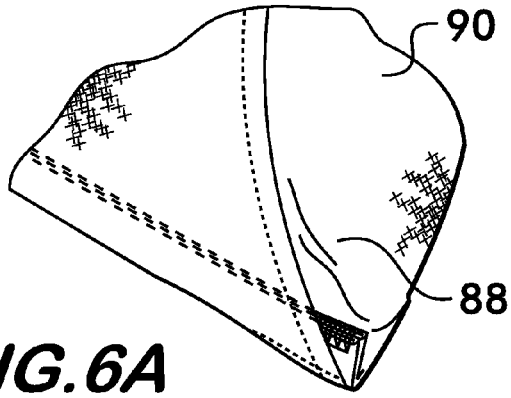
FIG. 6A is a exploded view of section 6A in FIG. 6.

The satellite pillow 64 is preferably similarly formed as a pillow case or cover 84 receiving a complementary sized insert pillow 86 within, which insert pillow 86 has a cover 68*a* and a cushion material 48 within such as fiber fill. It can be made of any suitable material such as fabrics and cloths typically used for bed pillow cases and covers, and made by any known means such as by known sewing/stitching techniques. Preferably, the satellite pillow 64 is made of the same material and construction as the main pillow 62. The insert pillow 86 can be inserted into the cover 68*a* through a side opening 88 as shown in FIGS. 6 and 6A having a flap 90 sewn to one side of the opening 88 to cover and maintain the insert pillow 84 within. As an alternative, shown in FIG. 7, the satellite pillow cover 84 can include a zipper 42 over the opening 88 to close and maintain the insert pillow 86 within. Another alternative is to add the cushion material 48 directly to the satellite pillow 64 after which it is sewn closed.

Figure 7:
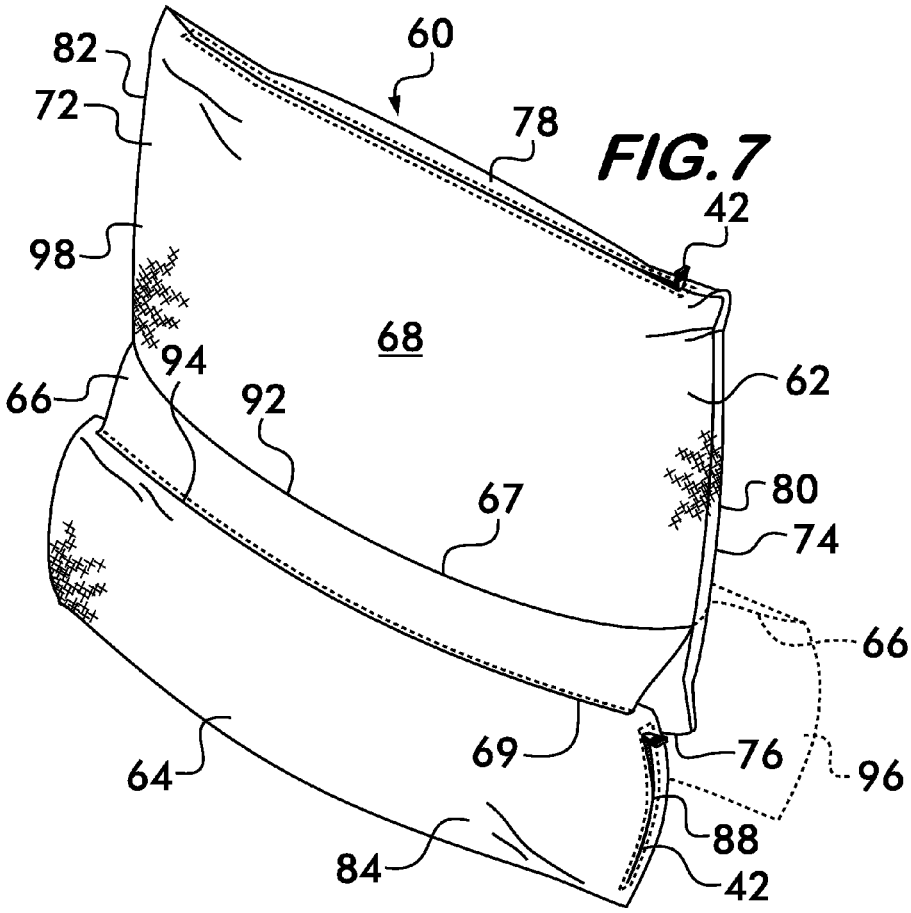
FIG. 7 is a perspective view similar to that of FIG. 6 but showing an alternative satellite pillow having a zipper.
Figure 8:
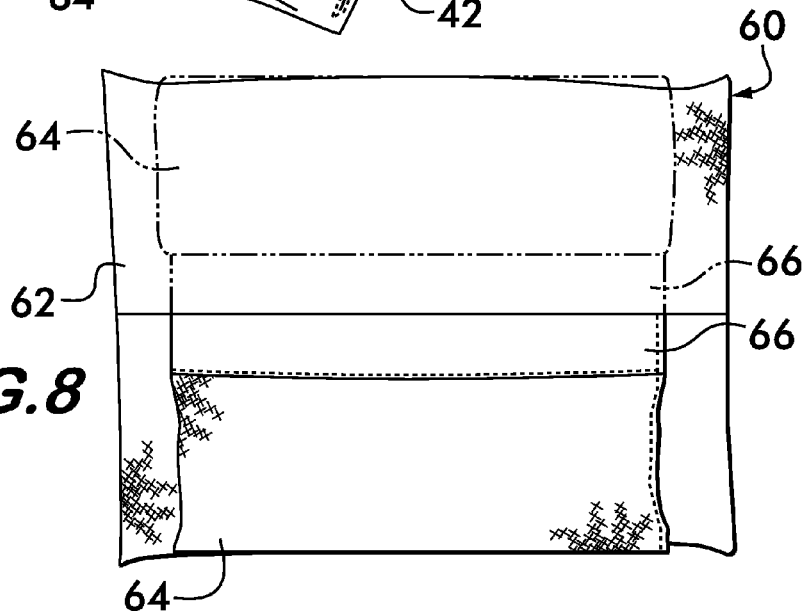
FIG. 8 is a front plan view of the pillow of FIG. 6 showing a satellite pillow in a first position and in a second position (in phantom lines)

The attachment member 66 is fixed at one end 67 to the main pillow 62 at seam 92 which extends along the entire face 72 of the main pillow 62 as shown, and the other end 69 to the satellite pillow 64 at one end seam 94. In one embodiment as illustrated, the attachment member 64 can have a shorter length than the attachment members of the comfort pillow 10 shown in FIG. 1 and described above. As with the embodiment of FIG. 1, the attachment member allows the satellite pillow 64 to be moved between a downward position and an upward position as shown in phantom in FIG. 8, and to parallel or skewed orientations relative to the main pillow. In the embodiment as shown in FIG. 7, the satellite pillow 64 is attached to the main pillow 62 via the attachment member 66 so as to rest near the lower end of the main pillow 62 when in the lower position and to act as an extension of the main pillow 62 and capable of contacting the surface on which the pillow 60 is resting, such as a bed. The attachment member 66 is preferably made of the same material as the cover material for the main and satellite pillows, but can be of any suitable material.

As with the previously described embodiment, the main pillow 62 can be formed as a pillow cover with a pre-made pillow inserted therein, or a finished self-contained pillow. Likewise for the smaller satellite pillow 64. The main pillow cover can be sized for any size pillow, and can be made slightly smaller in dimension as compared to the pillow to be inserted therein which may be beneficial when used with worn and old pillows.

Figure 9:
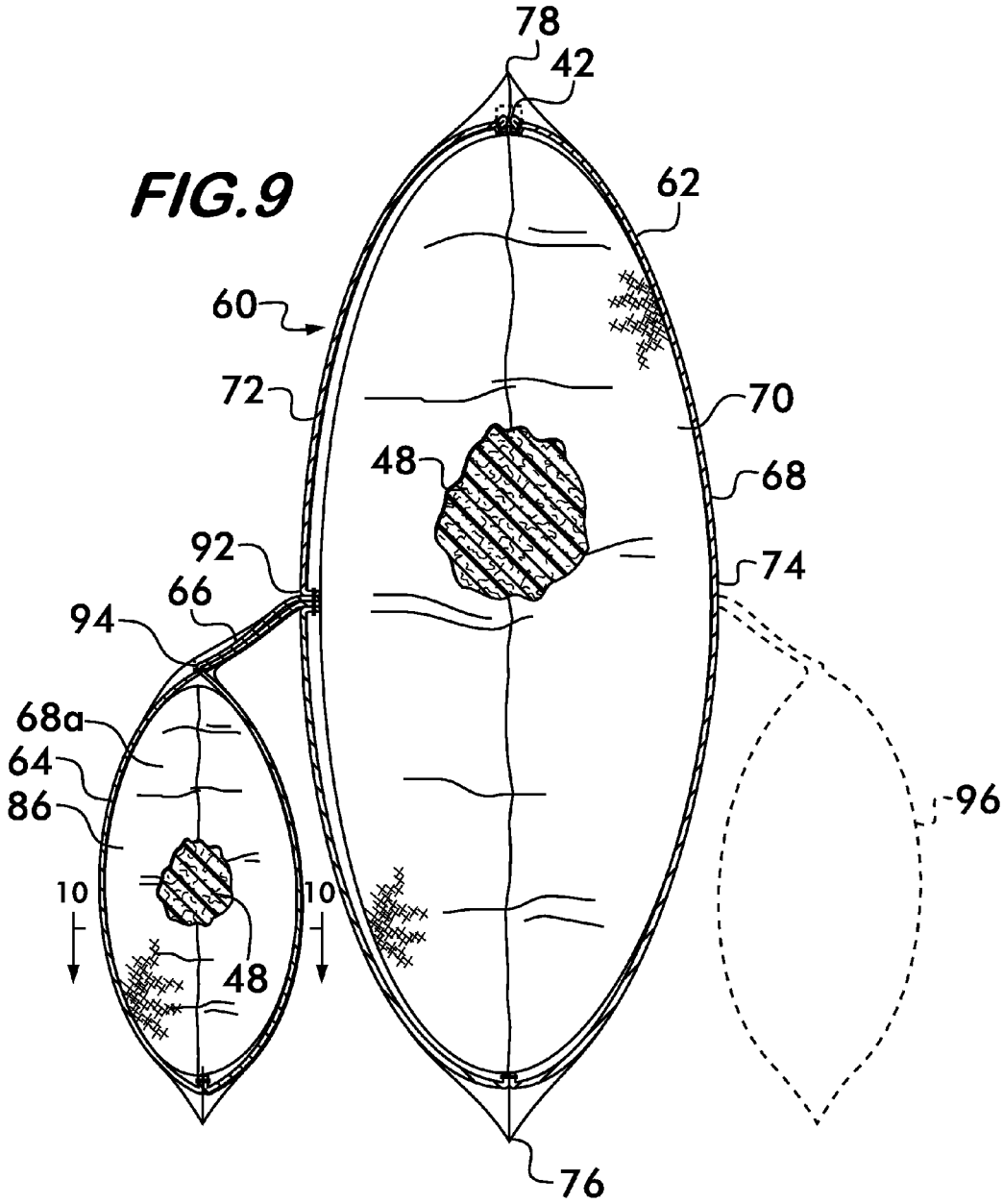
FIG. 9 is a side view of the pillow of FIG. 6 showing various sections partially removed.
Figure 10:
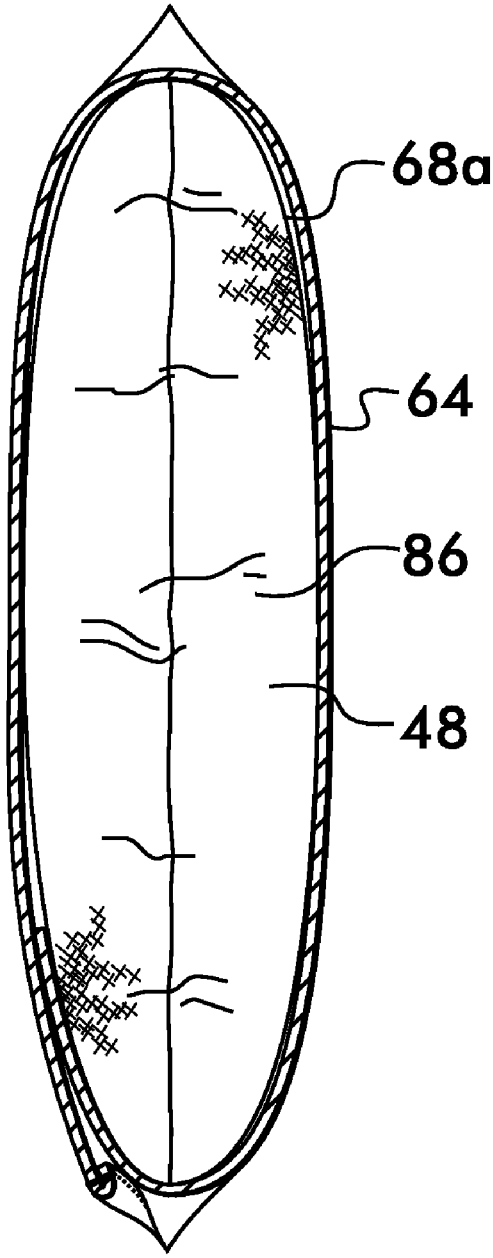
FIG. 10 is a sectional view taken along line 10-10 if FIG. 9.

As shown in FIGS. 7 and 9 in phantom lines, a second satellite pillow 96 can be provided. Such second satellite pillow could be similar in construction, firmness and configuration as the first satellite pillow, or different as desired. In comparing the embodiments of FIGS. 6 and 7, it is seen that the satellite pillows can be attached to the main pillow at different lengths along the face of the main pillow. For example, for the pillow 60 in FIG. 6, the satellite pillow 64 is attached to the main pillow 62 at a midsection 98 of the face 72 of the main pillow 62. In contrast, the pillow 60 of FIG. 7 has the satellite pillow 64 attached closer to the end 76 of the main pillow, here approximately half way between the midsection 98 and end.

The bed pillow can be made to any desired size, but preferably is made to work with standard sized pillows, e.g., king (20 by 36 inches), queen (20 by 30 inches), standard (20 by 26 inches), European, etc. As an example, for a standard sized multi-adjustable bed pillow 60 having a single satellite pillow, the main pillow 62 may have a pillow cover 68 sized to receive within it a standard sized pillow 70 as would any known pillow cover. Attached to the cover 68 via the attachment member 66 is the satellite pillow 64 having a pillow cover 84 that is 16 inches width W by 7½ inches length L for receiving a pillow insert 86 that is 14 inches width by 7 inches length. The attachment member 66 is 16 inches width by 2½ inches length and attached to the main pillow 10 inches length from the bottom end. In one embodiment, the attachment member 66 is sewn to the main pillow 62 at the midsection of the face of the main pillow. In another embodiment, the satellite pillow is positioned between 9-12 inches from the top of the pillow.

It is appreciated that the use of terms such as "main" and "satellite" pillows are descriptive only and not meant to imply any special meaning or limitations to the invention. Terms such as "first" and "second" pillow could have been used instead with the same meaning. Relevant terms such as "top" and "bottom" are likewise not meant to be limiting as these terms can be switched with one another. Accordingly, the invention is to be limited only by the claims appended hereto.

What is claimed:

1. A pillow comprising:

a main pillow, said main pillow having first and second faces opposite one another and which are attached at top and bottom ends and at first and second side ends opposite one another, said main pillow having a fabric exterior and a cushioned interior, said main pillow having a length and a width;

a generally rectangular first satellite pillow adjustably attached to said first face of said main pillow, said first satellite pillow having a length smaller than that of said main pillow, said first satellite pillow having a fabric exterior and a cushioned interior;

a first attachment member for adjustably attaching said first satellite pillow to said first face of said main pillow, said first attachment member having a first end attached to said first face between said top and bottom ends and being sufficiently flexible so that said first satellite pillow can be adjustably positioned relative to said main pillow at substantially parallel or skewed orientations, said first attachment member having a width less than the width of said first satellite pillow and said main pillow;

a generally rectangular second satellite pillow adjustably attached to said second face of said main pillow, said second satellite pillow having a length smaller than that of said main pillow, said second satellite pillow having a fabric exterior and a cushioned interior;

a second attachment member for adjustably attaching said second satellite pillow to said second face of said main pillow, said second attachment member having a first end attached to said second face between said top and bottom ends and being sufficiently flexible so that said second satellite pillow can be positioned relative to said first pillow at substantially parallel or skewed orientations; and wherein said first and second attachment members are configured so that one of the first and second satellite pillows in all positions relative to said main pillow remains substantially over the main pillow and the other of said first and second satellite pillows in all positions relative to said main pillow remains substantially underneath the main pillow when one of said first and second faces of said main pillow is facing a surface on which said pillow is resting.

2. The pillow of claim 1 wherein the length of said first satellite pillow is greater than the length of said second satellite pillow.

3. The pillow of claim 2 wherein said first satellite pillow is attached to said first face of said main pillow at a distance from said top end of said main pillow that is different than the distance from said top end that said second satellite pillow is attached to said second face.

4. The pillow of claim 1 wherein said first satellite pillow has a width less than that of said main pillow.

5. The pillow of claim 4 wherein said second satellite pillows has a width less than that of said main pillow.

6. The pillow of claim 3 wherein said second satellite pillow has a width less than that of said first satellite pillow.

7. The pillow of claim 1 wherein said second attachment member has a width less than the width of said second satellite pillow and said main pillow.

8. The pillow of claim 1 wherein said first attachment member is formed of two layers of fabric sewn together in a face to face relationship.

9. The pillow of claim 1 wherein said main pillow is generally rectangular in shape.

10. The pillow of claim 1 wherein said first satellite pillow cushioned interior comprises soft fiber fill.

11. The pillow of claim 1 wherein said first satellite pillow cushioned interior comprises an inflatable bladder to control firmness.

12. The pillow of claim 1 wherein said main pillow comprises a pillow cover having a zipper for closing an opening in said cover, and a pillow insert positioned within said pillow cover and which is removable through said cover opening.

13. A pillow case, comprising:

a main pillow cover having an opening for receiving an insert pillow therein, said first pillow cover having opposing first and second faces connected to one another at top and bottom ends;

a first satellite pillow cover smaller in length than said main pillow cover and having an opening for receiving a pillow insert therein, said first satellite pillow cover attached to said first face of said main pillow cover;

an attachment member connecting said first satellite pillow cover to said main pillow cover, said attachment member having one end attached to said first face of said main pillow cover and another end attached to said first satellite pillow cover, said attachment member being sufficiently flexible so that said first satellite pillow cover can be adjustably positioned relative to said main pillow cover at parallel or skewed orientations;

a second satellite pillow cover smaller in length than said main pillow cover and having an opening for receiving a pillow insert therein, said second satellite pillow cover attached to said second face of said main pillow cover;

a second attachment member connecting said second satellite pillow cover to said main pillow cover, said second attachment member having one end attached to said second face of said main pillow cover and another end attached to said second satellite pillow cover, said attachment member being sufficiently flexible so that said first satellite pillow cover can be adjustably positioned relative to said main pillow cover at parallel or skewed orientations; and wherein said first and second attachment members are configured so that one of the first and second satellite pillow covers in all positions relative to said main pillow cover remains substantially over the main pillow cover and the other of said first and second satellite pillow covers in all positions relative to said main pillow cover remains substantially underneath the main pillow cover when one of said first and second faces of said main pillow cover is facing a surface on which said pillow case is resting.

14. The pillow case of claim 13 wherein said opening of first attachment pillow cover is positioned on a side of said cover.

15. The pillow case of claim 13 wherein said attachment member is attached to said face of said main pillow cover at a midsection of said main pillow.

16. The pillow case of claim 13 wherein said first satellite pillow has a width less than the width of said first satellite pillow.

17. The pillow of claim 11 wherein said second satellite pillow cushioned interior and said main pillow cushioned interior comprises an inflatable bladder to control firmness.

18. A pillow case, comprising:

a main pillow cover having an opening for receiving an insert pillow therein, said first pillow cover having opposing first and second faces connected to one another at top and bottom ends;

a first satellite pillow cover smaller in length than said main pillow cover and having an opening for receiving a pillow insert therein, said first satellite pillow cover attached to said first face of said main pillow cover;

an attachment member connecting said first satellite pillow cover to said main pillow cover, said attachment member having one end attached to said first face of said main pillow cover and another end attached to said first satellite pillow cover, said attachment member being sufficiently flexible so that said first satellite pillow cover can be adjustably positioned relative to said main pillow at parallel or skewed orientations;

a second satellite pillow cover smaller in length than said main pillow cover and having an opening for receiving a pillow insert therein, said second satellite pillow cover attached to said second face of said main pillow cover;

a second attachment member connecting said second satellite pillow cover to said main pillow cover, said second attachment member having one end attached to said second face of said main pillow cover and another end attached to said second satellite pillow cover, said attachment member being sufficiently flexible so that said first satellite pillow cover can be adjustably positioned relative to said main pillow at parallel or skewed orientations; and wherein said first satellite pillow cover is attached to said main pillow cover via said first attachment member so as to be capable of being adjustably positioned to rest near said lower end of said main pillow cover and act as an extension of the main pillow cover and capable of contacting the surface on which said pillow cover is resting when said second face of said pillow cover is resting on said surface;

wherein said second attachment member is configured so that said second satellite pillow cover in all positions relative to said main pillow cover remains substantially over the main pillow cover when said first face of said main pillow cover is facing a surface on which said pillow case is resting, and said second satellite pillow cover in all positions relative to said main pillow cover remains substantially underneath the main pillow cover when said second face of said main pillow cover is facing the surface on which said pillow case is resting.

* * * * *